US010506909B2

(12) United States Patent
Park et al.

(10) Patent No.: US 10,506,909 B2
(45) **Date of Patent: *Dec. 17, 2019**

(54) DISH WASHER

(71) Applicant: SAMSUNG ELECTRONICS CO., LTD., Suwon-si, Gyeonggi-do (KR)

(72) Inventors: Ki Tae Park, Daegu (KR); Sung Jin Kim, Suwon-si (KR); Chang Wook Lee, Seoul (KR); Heon Ho Jeong, Hwaseong-si (KR); Jae Man Joo, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 676 days.

This patent is subject to a terminal disclaimer.

(21) Appl. No.: 15/108,692

(22) PCT Filed: Dec. 24, 2014

(86) PCT No.: PCT/KR2014/012819

§ 371 (c)(1),
(2) Date: Jun. 28, 2016

(87) PCT Pub. No.: WO2015/102298

PCT Pub. Date: Jul. 9, 2015

(65) Prior Publication Data

US 2016/0324394 A1 Nov. 10, 2016

(30) Foreign Application Priority Data

Dec. 31, 2013 (KR) ..... 10-2013-0169461

(51) Int. Cl.
*A47L 15/42* (2006.01)
*A47L 15/16* (2006.01)

(52) U.S. Cl.
CPC ..... *A47L 15/4221* (2013.01); *A47L 15/16* (2013.01); *A47L 15/4282* (2013.01)

(58) Field of Classification Search
None
See application file for complete search history.

(56) References Cited

U.S. PATENT DOCUMENTS 2,873,141 A 2/1959 Myllenberg et al.
3,051,184 A 8/1962 Gibson
(Continued)

FOREIGN PATENT DOCUMENTS

CN 103462574 12/2013
EP 2671494 A1 12/2013
(Continued)

OTHER PUBLICATIONS

International Search Report dated Mar. 9, 2015 in corresponding International Patent Application No. PCT/KR2014/012819.
(Continued)

*Primary Examiner* — Levon J Shahinian
*Assistant Examiner* — Jason P Riggleman
(74) *Attorney, Agent, or Firm* — Staas & Halsey LLP

(57) ABSTRACT

Disclosed is a dishwasher having a structure improved to enhance the efficiency of washing. The dishwasher includes a main body, a washing tub provided in the main body, a door configured to close or open an open side of the washing tub, a fixed nozzle fixed on another side of the washing tub and configured to spray washing water, a vane configured to reflect the washing water sprayed via the fixed nozzle toward dishes while being moved within the washing tub, and a rail assembly configured to guide the movement of the vane. The vane is rotationally coupled to the rail assembly to change a direction of movement of the washing water sprayed via the fixed nozzle.

20 Claims, 19 Drawing Sheets

(56) References Cited

U.S. PATENT DOCUMENTS

| | | | | |
|---|---|---|---|---|
| 3,176,697 | A | 4/1965 | Gibson | |
| 9,706,896 | B2 * | 7/2017 | Hong | A47L 15/18 |
| 2014/0345655 | A1 * | 11/2014 | Park | A47L 15/16<br>134/183 |

FOREIGN PATENT DOCUMENTS

| | | |
|---|---|---|
| JP | 64-25065 | 2/1989 |
| JP | 7-116102 | 5/1995 |
| JP | 7-163505 | 6/1995 |
| JP | 2009-219788 | 10/2009 |
| KR | 20-0307593 | 3/2003 |
| KR | 10-2006-0128399 | 12/2006 |

OTHER PUBLICATIONS

International Written Opinion of the International Searching Authority dated Mar. 9, 2015 in corresponding International Patent Application No. PCT/KR2014/012819.

Extended European Search Report dated May 4, 2017 in corresponding European Patent Application No. 14877236.1.

European Office Action dated Oct. 19, 2017 in corresponding European Patent Application No. 14 877 236.1.

Chinese Office Action dated May 3, 2018 in Chinese Patent Application No. 201480075239.3.

Chinese Notice of Allowance dated Jan. 31, 2019 in corresponding Chinese Patent Application No. 201480075239.3 (2 pages).

European Intention to Grant dated Feb. 28, 2019 in corresponding European Patent Application No. 14877236.1 (54 pages).

Korean Office Action issued Sep. 10, 2019 in related Korean Application No. 10-2013-0169461.

* cited by examiner

DISH WASHER

CROSS-REFERENCE TO RELATED APPLICATIONS

This application is a U.S. National Stage Application, which claims the benefit under 35 U.S.C. § 371 of PCT International Patent Application No. PCT/KR2014/012819, filed Dec. 24, 2014, which claims the foreign priority benefit under 35 U.S.C. § 119 of Korean Patent Application No. 10-2013-0169461, filed Dec. 31, 2013, the contents of which are incorporated herein by reference.

TECHNICAL FIELD

The present invention relates to a dishwasher, and more particularly, to a dishwasher having a structure improved to enhance the efficiency of washing.

BACKGROUND ART

A dishwasher is a household appliance which includes a main body having a washing tub therein, a basket for accommodating dishes, a sump for storing washing water, spray nozzles for spraying the washing water, and a pump for providing the washing water stored in the sump to the spray nozzles, and which is designed to wash the dishes by spraying the washing water at a high pressure to the dishes.

In general, a dishwasher employs a rotor-type injection structure with rotating spray nozzles. The rotating spray nozzles spray washing water while being rotated due to the pressure of the washing water. Since the rotating spray nozzles spray the washing water only within a range of radius of rotation, the washing water may not be sprayed to some regions of a washing tub. Thus, a so-called linear-type injection structure has been suggested to prevent occurrence of regions of the washing tub to which the washing water is not sprayed.

The linear-type injection structure includes fixed nozzles fixed at a side of a washing tub, and a vane configured to reflect washing water sprayed via the fixed spray nozzles toward dishes while being moved within the washing tub, and may thus spray the washing water to all regions of the washing tub as the vane is moved.

The fixed nozzles include a plurality of spray holes arranged in left and right directions of the washing tub, and are fixed onto a rear wall of the washing tub. The vane may be provided to extend in the left and right directions of the washing tub to reflect the washing water sprayed via the plurality of spray holes, and to make a reciprocating motion between the front and rear of the washing tub.

The linear-type injection structure may further include a driving device for driving the vane. The driving device may be embodied in many different forms. For example, the driving device may include a motor, a belt coupled to the motor to transfer a driving force to the vane, and a rail configured to guide movement of the vane, and may be configured such that when the motor is driven, the belt is rotated to move the vane along the rail.

In the linear-type injection structure, a distribution device which distributes washing water stored in a sump to spray nozzles may have a different structure from that of a distribution device of the rotor-type injection structure.

When the spray nozzles at the bottom of the washing tub are rotating nozzles, an outlet of the distribution device may be provided to face upward, so that a channel connecting the outlet of the distribution device and the rotating nozzles may be short and pressure loss of the washing water may be minimized However, when the spray nozzles at the bottom of the washing tub are fixed nozzles, the fixed nozzles are located adjacent to a rear wall of the washing tub and thus the outlet of the distribution device need not be provided to face upward. Rather, when the outlet of the distribution device faces upward, the channel connecting the outlet and the fixed nozzles should be bent toward the rear of the outlet, starting from the outlet. Thus the pressure loss of the washing water may increase.

Meanwhile, in the linear-type injection structure, the spray nozzles are fixed and thus the washing water is distributed to only some of the entire spray nozzles. Accordingly, localized washing may be performed, in which the washing water is sprayed to only some regions of the washing tub.

DISCLOSURE

Technical Problem

One aspect of the present invention is directed to a dishwasher having an improved structure, in which a rotational vane is employed to control a direction in which washing water is sprayed.

Technical Solution

One aspect of the present invention provides a dishwasher including a main body; a washing tub provided in the main body; a door configured to close or open an open side of the washing tub; a fixed nozzle fixed on another side of the washing tub and configured to spray washing water; a vane configured to reflect the washing water sprayed via the fixed nozzle toward dishes while being moved within the washing tub; and a rail assembly configured to guide the movement of the vane. The vane is rotationally coupled to the rail assembly to change a direction of movement of the washing water sprayed via the fixed nozzle.

The vane may be rotated at opposite ends of the rail assembly.

The rail assembly may include a rail extending in a first direction facing the door and a second direction facing the fixed nozzle; and a vane holder coupled to the rail to be moved in the first direction and the second direction. The vane may be coupled to the vane holder to be moved as one body with the vane holder along the rail.

The vane holder may include a coupling protrusion protruding toward an outer side of the vane holder such that the vane is rotationally coupled to the vane holder; and a casing integrally formed with the vane holder to be provided in front of the coupling protrusion.

The rail assembly may further include a stopping unit configured to fix the vane in a state in which the vane is rotated. The stopping unit may be coupled to the casing to be moved along the rail together with the vane holder.

A stopping protrusion protruding in the first direction may be provided on a first surface of the vane facing the first direction. The stopping protrusion may be supported by the stopping unit to fix the vane in a state in which the vane is rotated.

The rail assembly may further include a holder formed on one end of the rail facing the first direction. A push unit protruding toward an outer side of the holder may be provided at a side of the holder to push out the stopping unit in the second direction.

The vane may include a coupling groove combined with the coupling protrusion; and a plurality of hooks forming the coupling groove.

When the push unit pushes out one end of the stopping unit in the second direction, another end of the stopping unit may push out one of the plurality of hooks in the second direction to rotate the vane about the coupling protrusion.

The dishwasher may further include a bottom plate cover coupled to one side of a bottom plate of the washing tub and the fixed nozzle. A rotation guide protruding toward the first direction may be provided on the bottom plate cover.

A rotation stopper may be provided on a second surface of the vane facing the second direction to correspond to the rotation guide. The rotation guide may interfere with the rotation stopper to rotate the vane. The vane may be fixed in a state in which the vane is rotated while the stopping protrusion is supported by the stopping unit.

Another aspect of the present invention provides a dishwasher including a main body; a washing tub provided in the main body; a door configured to close or open an open front of the washing tub; a fixed nozzle fixed on a rear of the washing tub and configured to spray washing water; a bottom plate cover coupled to a rear of a bottom plate of the washing tub to be coupled to the fixed nozzle; a vane configured to reflect the washing water sprayed via the fixed nozzle toward dishes while being moved within the washing tub; and a rail assembly configured to guide the movement of the vane. The rail assembly includes a rail extending along the front and rear of the washing tub; and a vane holder coupled to the rail to be moved along the rail. The vane is coupled to the vane holder to be rotated at opposite ends of the rail and to be moved along the rail while being fixed in a state in which the vane is rotated.

The vane may be rotationally coupled to an outer side of the vane holder. A rotation limiting unit facing an outer surface of the vane holder may be formed on a first surface of the vane facing the front of the washing tub, wherein a degree to which the rotation limiting unit is separated from the vane holder changes as the vane is rotated.

The vane holder may include a coupling protrusion protruding toward the outer side thereof such that the vane is rotatably coupled to the vane holder.

The rail assembly may further include a stopping unit coupled to one side of the vane holder to be provided in front of the coupling protrusion, and configured to be moved along the rail together with the vane holder.

The rail assembly may further include a holder formed on one end of the rail facing the front of the washing tub. A push unit protruding toward an outer side of the holder may be provided at a side of the holder to push out the stopping unit toward the rear of the washing tub.

When the push unit pushes out one end of the stopping unit toward the rear of the washing tub, the vane may be rotated to decrease the degree to which the rotation limiting unit is separated from the vane holder.

The rotation limiting unit may be supported on the vane holder to limit the rotation of the vane. The vane may be moved along the rail toward the rear of the washing tub while being fixed in a state in which the rotation limiting unit is supported on the vane holder.

A rotation guide protruding toward the front of the washing tub may be provided on the bottom plate cover.

A rotation stopper may be provided on a second surface of the vane facing the rear of the washing tub to correspond to the rotation guide. When the rotation guide interferes with the rotation stopper, the vane may be rotated to increase the degree to which the rotation limiting unit is separated from the vane holder.

A stopping protrusion protruding toward the front of the washing tub may be further formed on the first surface of the vane. The vane may be moved along the rail toward the front of the washing tub while being fixed in a state in which the stopping protrusion is supported on the stopping unit.

The vane may be rotated on one end of the rail facing the front of the washing tub such that an upper end of the vane faces the front of the washing tub, and be rotated on another end of the rail facing the rear of the washing tub such that the upper end of the vane faces the rear of the washing tub.

Advantageous Effects

Since a rotational vane is used, a direction in which washing water is sprayed may be easily controlled, thereby preventing dead zones from being formed.

The washing water may be stably sprayed toward dishes by fixing the vane to a state in which the vane is rotated.

The washing water may be uniformly sprayed toward dishes by fixing the vane to a state in which the vane is rotated, thereby improving the efficiency of washing of the dishwasher.

MODES OF THE INVENTION

Hereinafter, exemplary embodiments of the present invention will be described in detail. In the present disclosure, the terms 'front end', 'rear end', 'top', 'bottom', 'upper end', 'lower end', etc. are defined based on the drawings and thus the shapes and positions of elements of the present invention are not limited by these terms.

Figure 1:
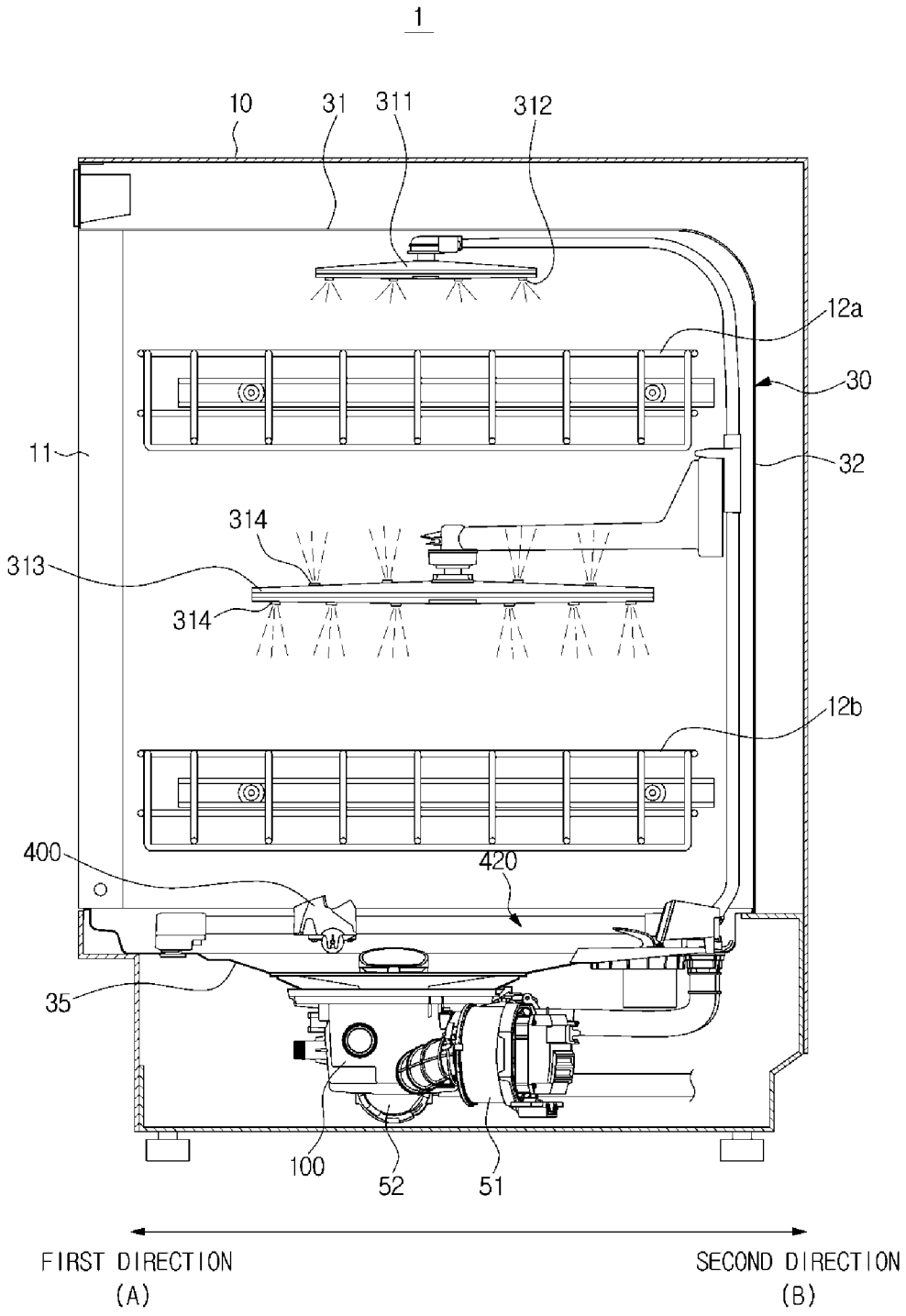
FIG. 1 is a schematic cross-sectional view of a dishwasher according to an embodiment of the present invention.
Figure 2:
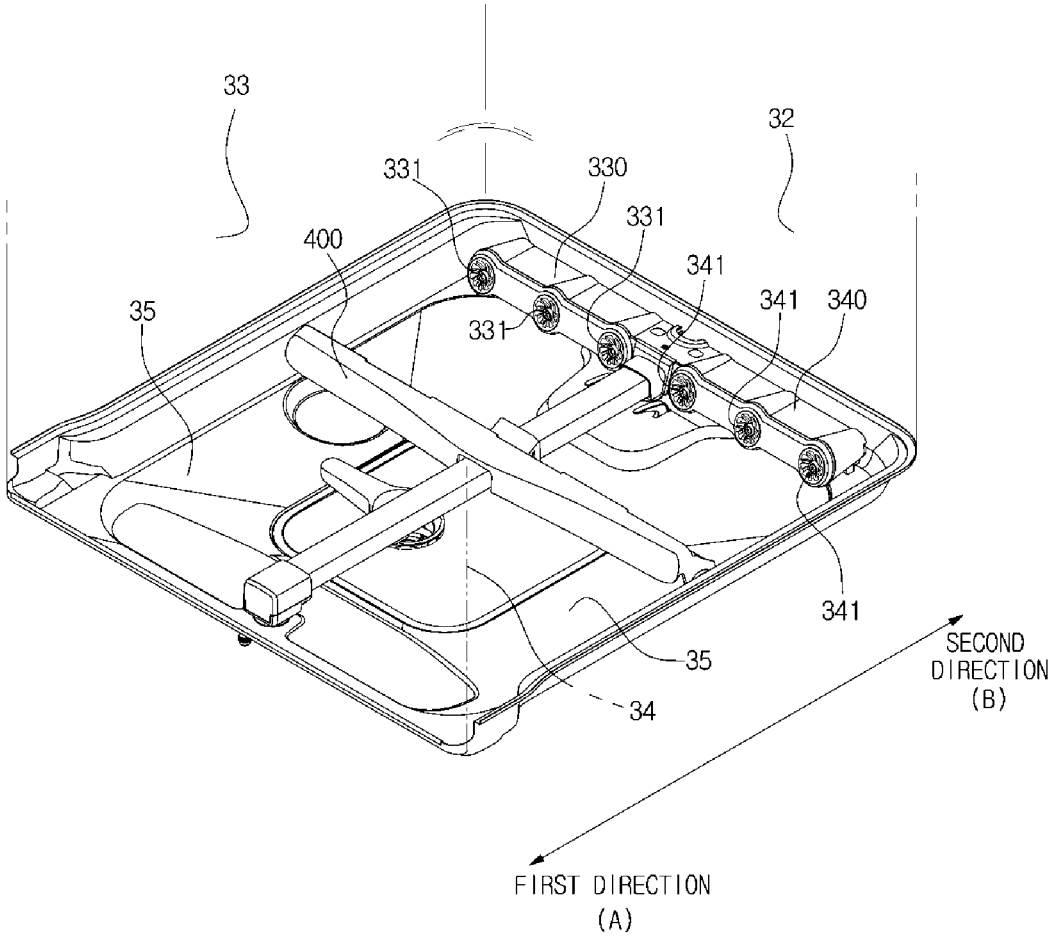
FIG. 2 is a diagram illustrating the bottom of the dishwasher of FIG. 1.

FIG. 1 is a schematic cross-sectional view of a dishwasher according to an embodiment of the present invention. FIG. 2 is a diagram illustrating the bottom of the dishwasher of FIG. 1.

A whole structure of a dishwasher according to an exemplary embodiment of the present invention will be briefly described with reference to FIGS. 1 and 2 below.

A dishwasher 1 includes a main body 10 forming an external appearance of the dishwasher 1; a washing tub 30 provided in the main body 10; baskets 12*a* and 12*b* provided in the washing tub 30 to accommodate dishes; spray nozzles 311, 313, 330, and 340 configured to spray washing water; a sump 100 configured to store the washing water; a circulating pump 51 configured to pump the washing water stored in the sump 100 to be supplied to the spray nozzles 311, 313, 330, and 340; a drainage pump 52 configured to discharge the washing water stored in the sump 100 together with garbage to the outside of the main body 10; a vane 400 configured to reflect the washing water toward the dishes while being moved within the washing tub 30; and a driving device 420 configured to drive the vane 400.

The washing tub 30 may have a roughly box shape, the front of which is open such that dishes may be loaded into or unloaded from the washing tub 30. The open front of the washing tub 30 may be opened or closed through a door 11. The washing tub 30 may include an upper wall 31, a rear wall 32, a left wall 33, a right wall 34, and a bottom plate 35.

The baskets 12*a* and 12*b* may be wire racks formed of wire such that washing water may pass through the baskets 12*a* and 12*b* without being collected therein. The baskets 12*a* and 12*b* may be attachable to or detachable from the inside of the washing tub 30. The baskets 12*a* and 12*b* may include the upper basket 12*a* at the top of the washing tub 30, and the lower basket 12*b* at the bottom of the washing tub 30.

The spray nozzles 311, 313, 330, and 340 may spray washing water at a high pressure to wash dishes. The spray nozzles 311, 313, 330, and 340 may include the upper rotating nozzle 311 at the top of the washing tub 30, a middle rotating nozzle 313 at a central portion of the washing tub 30, and fixed nozzles 330 and 340 at the bottom of the washing tub 30.

The upper rotating nozzle 311 may be provided above the upper basket 12*a*, and spray washing water downward while being rotated due to the pressure of the washing water. To this end, spray holes 312 may be provided at the bottom of the upper rotating nozzle 311. The upper rotating nozzle 311 may directly spray washing water toward the dishes accommodated in the upper basket 12*a*.

The middle rotating nozzle 313 may be provided between the upper basket 12*a* and the lower basket 12*b*, and spray washing water in a vertical direction while being rotated due to the pressure of the washing water. To this end, spray holes 314 may be provided at the top and bottom of the middle rotating nozzle 313. The middle rotating nozzle 313 may directly spray washing water toward the dishes accommodated in the upper basket 12*a* and the lower basket 12*b*.

The fixed nozzles 330 and 340 are provided not to be moved unlike the rotating nozzles 311 add 313, and are fixed at a side of the washing tub 30. The fixed nozzles 330 and 340 may be arranged roughly close to the rear wall 32 of the washing tub 30, and spray washing water toward the front of the washing tub 30. Thus, the washing water sprayed via the fixed nozzles 330 and 340 may not be directly headed to the dishes.

The washing water sprayed via the fixed nozzles 330 and 340 may be reflected toward the dishes through the vane 400. The fixed nozzles 330 and 340 may be provided below the lower basket 12*b*. The vane 400 may reflect the washing water sprayed via the fixed nozzles 330 and 340 in an upward direction. That is, the washing water sprayed via the fixed nozzles 330 and 340 may be reflected toward the dishes accommodated in the lower basket 12*b* through the vane 400.

The fixed nozzles 330 and 340 may include a plurality of spray holes 331 and 341 arranged in left and right directions of the washing tub 30. Washing water may be sprayed in a forward direction via the plurality of spray holes 331 and 341.

The vane 400 may extend to be long in the left and right directions of the washing tub 30 so as to completely reflect the washing water sprayed via the plurality of spray holes 331 and 341 of the fixed nozzles 330 and 340. That is, one end of the vane 400 in a lengthwise direction thereof may be adjacent to the left wall 33 of the washing tub 30 and another end of the vane 400 in the lengthwise direction may be adjacent to the right wall 34 of the washing tub 30.

The vane 400 may make a linear reciprocating motion along a direction in which the washing water is sprayed via the fixed nozzles 330 and 340. That is, the vane 400 may make the linear reciprocating motion between the front and rear of the washing tub 30.

Accordingly, a linear-type injection structure including the fixed nozzles 330 and 340 and the vane 400 is capable of washing all regions of the washing tub 30 without causing a dead zone to occur, and is thus differentiated from an injection structure including rotating nozzles which is capable of spraying washing water only within a range of radius of rotation.

The fixed nozzles 330 and 340 may include the left fixed nozzle 330 at the left side of the washing tub 30, and the right fixed nozzle 340 at the right side of the washing tub 30.

The rotating nozzles 311 and 313 and the fixed nozzles 330 and 340 may spray washing water independently from one another. Similarly, the left fixed nozzle 330 and the right fixed nozzle 340 may spray the washing water independently from each other.

The washing water sprayed via the left fixed nozzle 330 may be reflected to only a left region of the washing tub 30 through the vane 400, and the washing water sprayed via the right fixed nozzle 340 may be reflected to only a right region of the washing tub 30 through the vane 400.

Thus, the dishwasher 1 may independently and locally wash the left side and the right side of the washing tub 30. However, embodiments of the present invention are not limited thereto, and the washing tub 30 may be further divided into sub-regions as well as the right and left sides if needed.

Figure 3:
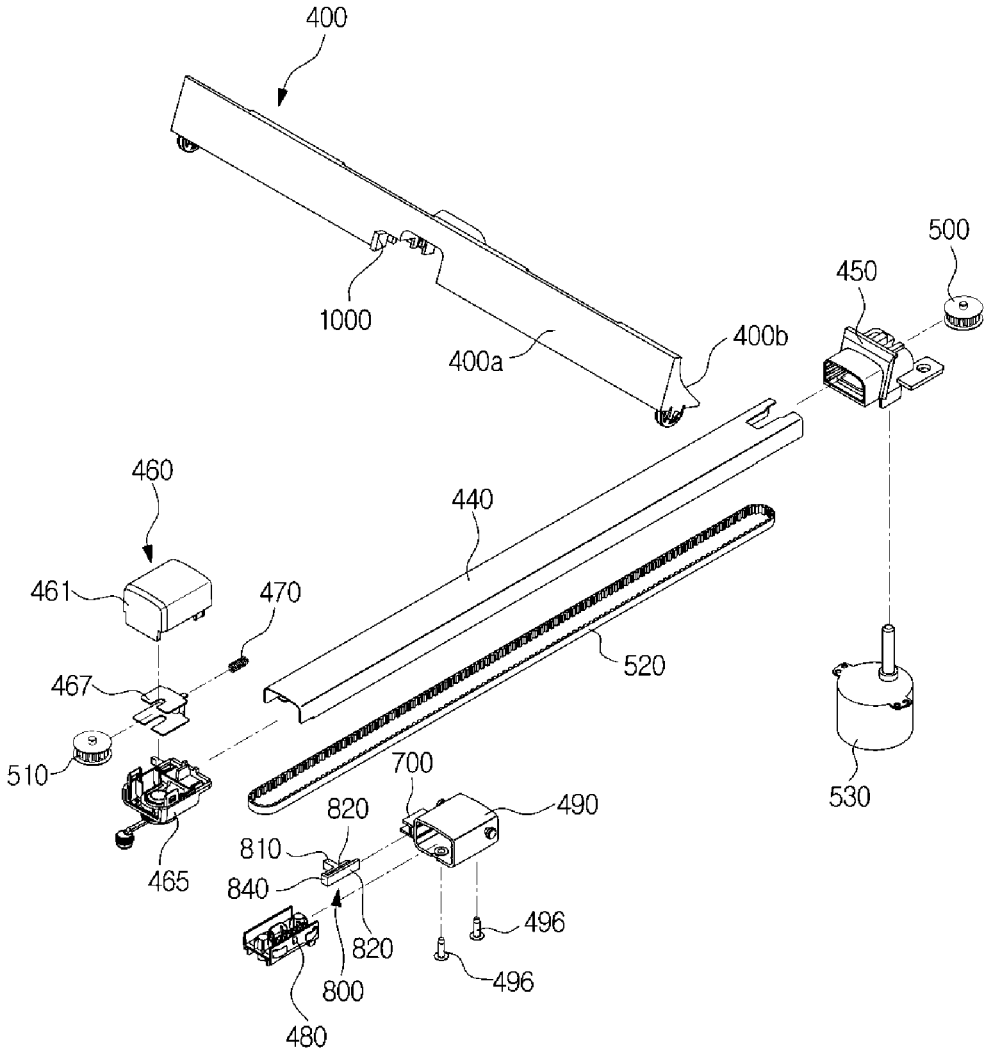
FIG. 3 is a diagram illustrating a vane and a driving device of the dishwasher of FIG. 1, in which an exploded view of the driving device is illustrated.
Figure 4:
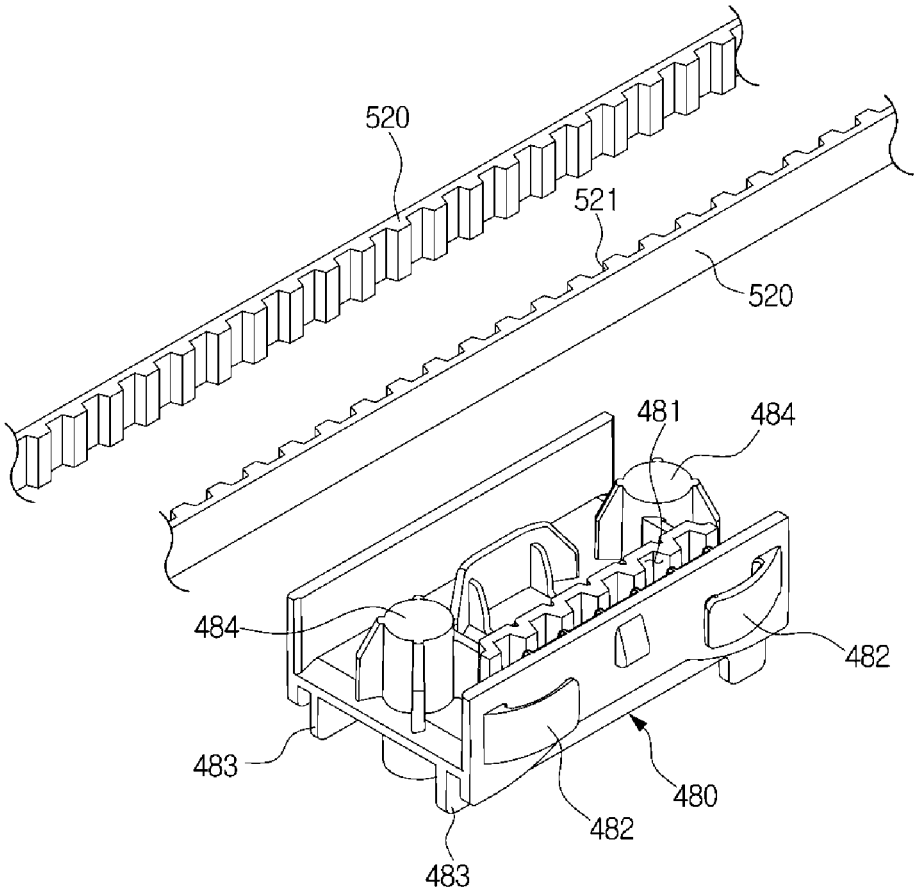
FIG. 4 is a diagram illustrating a belt and a belt holder of the dishwasher of FIG. 1.
Figure 5:
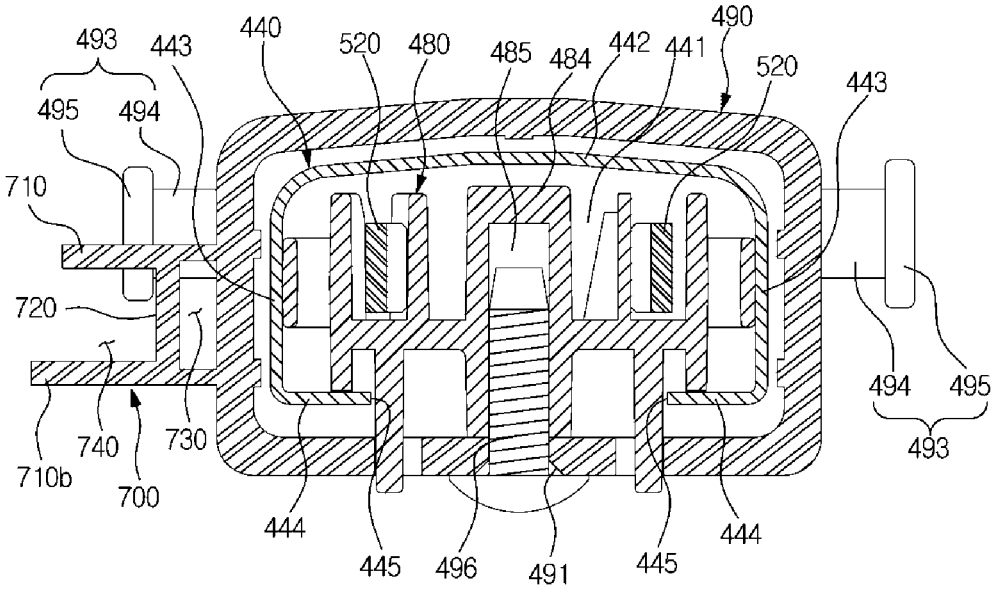
FIG. 5 is a cross-sectional view of a rail, a belt, a belt holder, and a vane holder of the dishwasher of FIG. 1.
Figure 6:
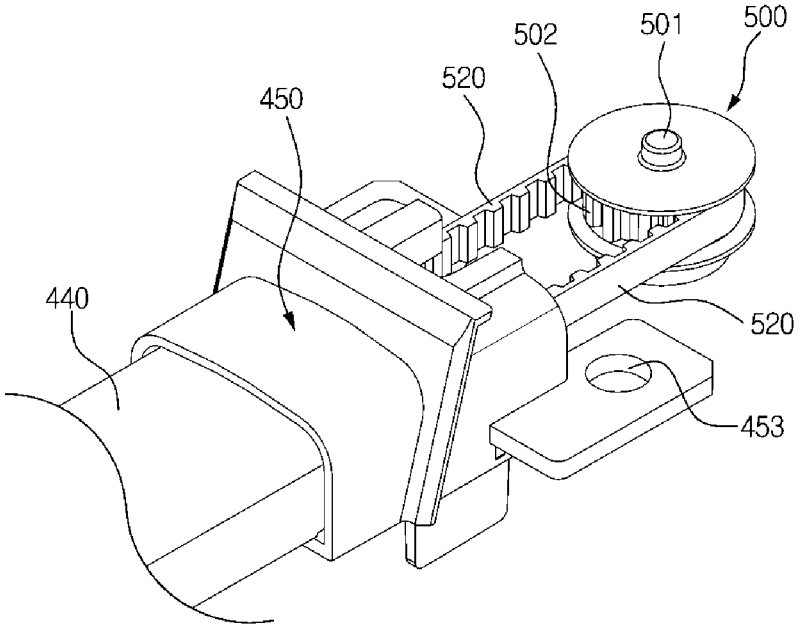
FIG. 6 is a diagram illustrating a rail, a belt, a driving pulley, and a rear holder of the dishwasher of FIG. 1.
Figure 7:
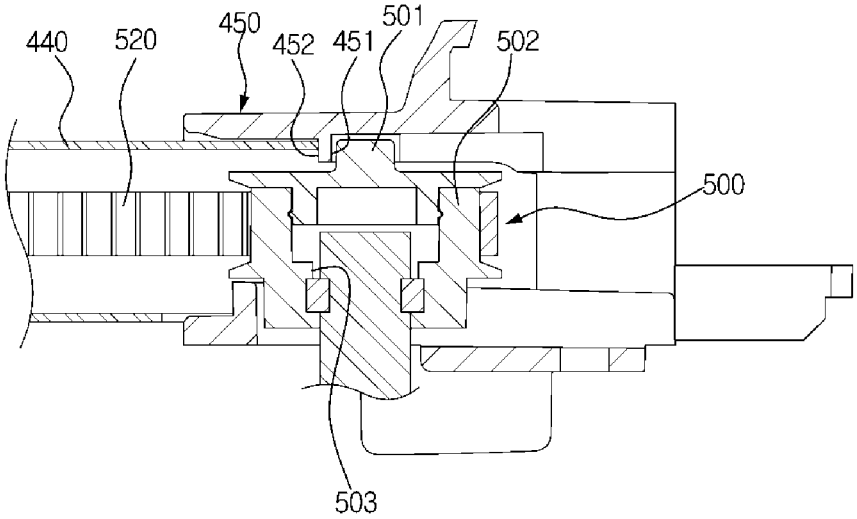
FIG. 7 is a cross-sectional view of a rail, a belt, a driving pulley, and a rear holder of the dishwasher of FIG. 1.
Figure 8:
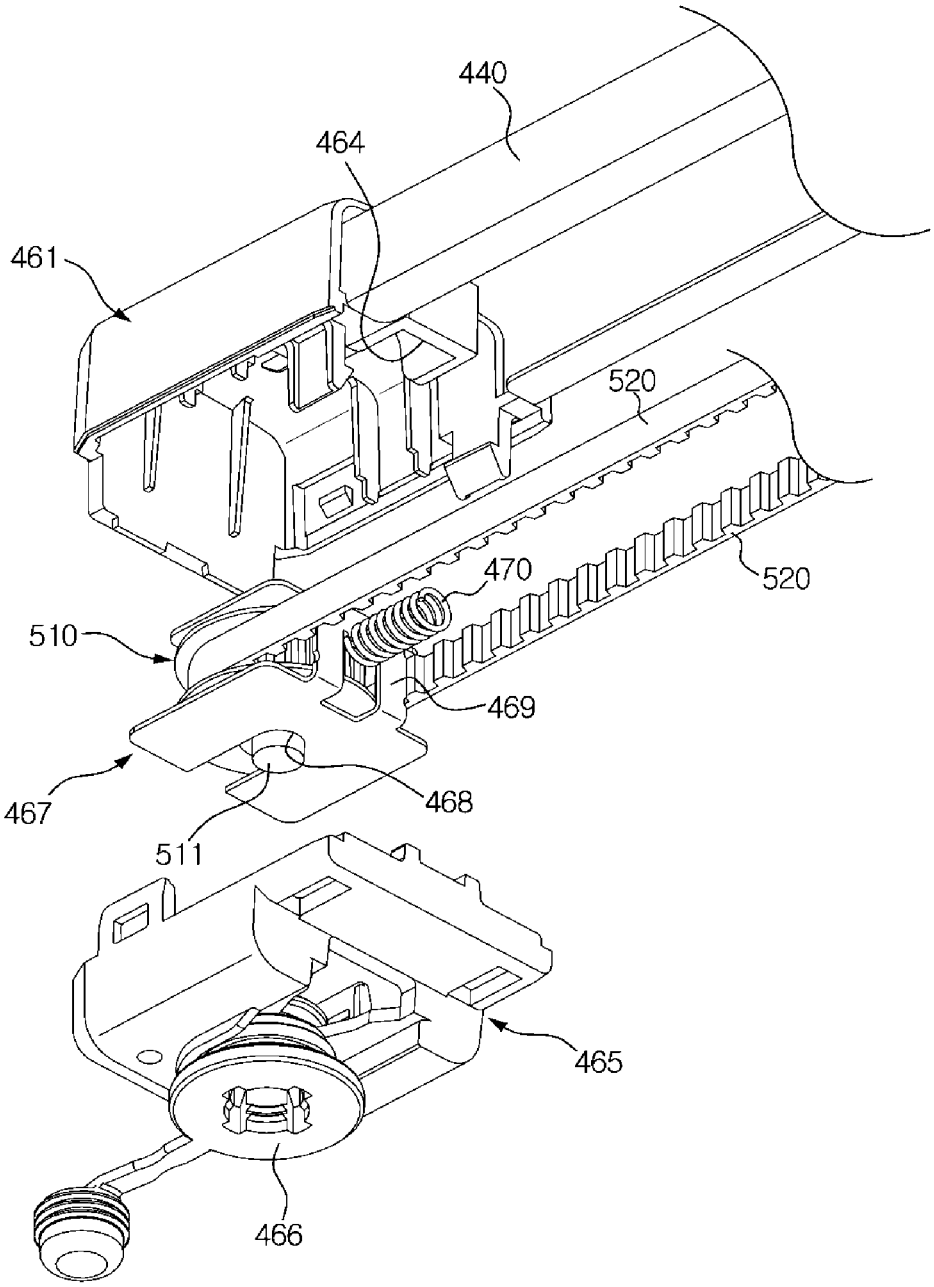
FIG. 8 is a diagram illustrating a rail, a belt, an idle pulley, and a front holder of the dishwasher of FIG. 1.
Figure 9:
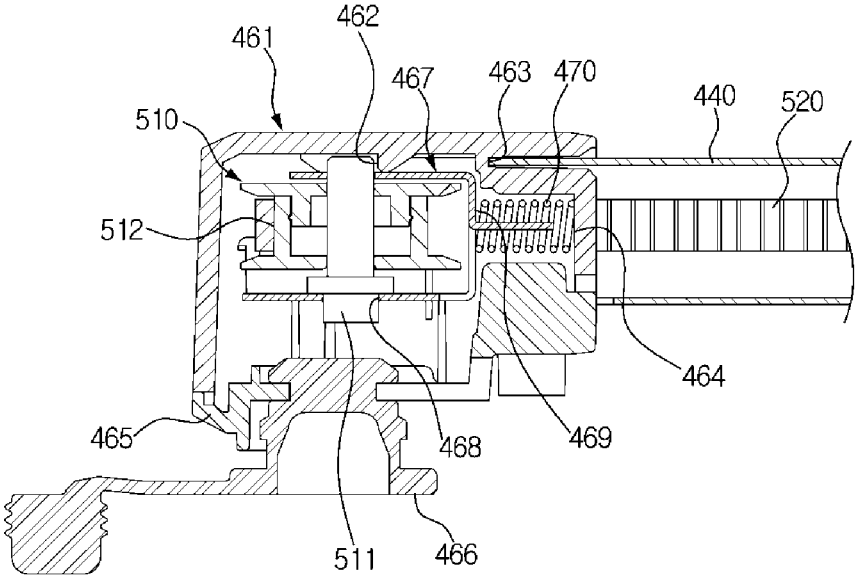
FIG. 9 is a cross-sectional view of a rail, a belt, an idle pulley, and a front holder of the dishwasher of FIG. 1.

FIG. 3 is a diagram illustrating a vane and a driving device of the dishwasher of FIG. 1, in which an exploded view of the driving device is shown. FIG. 4 is a diagram illustrating a belt and a belt holder of the dishwasher of FIG. 1. FIG. 5 is a cross-sectional view of a rail, a belt, a belt holder, and a vane holder of the dishwasher of FIG. 1. FIG. 6 is a diagram illustrating a rail, a belt, a driving pulley, and a rear holder of the dishwasher of FIG. 1. FIG. 7 is a cross-sectional view of a rail, a belt, a driving pulley, and a rear holder of the dishwasher of FIG. 1. FIG. 8 is a diagram illustrating a rail, a belt, an idle pulley, and a front holder of the dishwasher of FIG. 1. FIG. 9 is a cross-sectional view of a rail, a belt, an idle pulley, and a front holder of the dishwasher of FIG. 1. Hereinafter, the term 'holder' may be understood as being identical to a front holder 460. A first direction A and a second direction B may be opposite directions but embodiments of the present invention are not limited thereto. Hereinafter, for convenience of explanation, it is assumed that the first direction A is a direction toward the front of the washing tub 30 and the second direction B is a direction toward the rear of the washing tub 30. In the case of reference numerals that are not shown in FIGS. 3 to 9, the corresponding reference numerals illustrated in FIGS. 1 and 2 should be referred to.

As illustrated in FIGS. 3 to 9, the dishwasher 1 may include the vane 400 configured to reflect washing water sprayed via the fixed nozzles 330 and 340. The vane 400 may make a linear reciprocating motion along a direction in which the washing water is sprayed via the fixed nozzles 330 and 340. Furthermore, the vane 400 may be rotationally coupled to a rail assembly 430 to change a direction of movement of the washing water sprayed via the fixed nozzles 330 and 340. The vane 400 may be rotated at opposite ends of the rail assembly 430, and make a linear reciprocating motion in the direction in which the washing water is sprayed while being fixed in a state in which the vane 400 is rotated. Locations on which the vane 400 is rotated are not limited to the opposite ends of the rail assembly 430. However, for convenience of explanation, it is assumed that the vane 400 is rotated at the opposite ends of the rail assembly 430.

The dishwasher 1 may include the driving device 420 causing the vane 400 to make the linear reciprocating motion.

The driving device 420 may include a motor 530 which generates a driving force, and the rail assembly 430 which guides the movement of the vane 400.

The rail assembly 430 may include a rail 440 which guides the movement of the vane 400 and has an inner space 441; a driving pulley 500 rotated while being connected to the motor 530; a belt 520 which is rotated while being coupled to the driving pulley 500, and provided in the inner space 441 of the rail 440; an idle pulley 510 connected to the belt 520 to support the belt 520 such that the belt 520 may be rotated; a belt holder 480 provided in the inner space 441 of the rail 440 to make a linear reciprocating motion while being coupled to the belt 520; a vane holder 490 located outside the rail 440 to make a linear reciprocating motion while being coupled to the belt holder 480, and coupled to the vane 400; a rear holder 450 supporting the driving pulley 500 such that the driving pulley 500 is rotational, and coupled to a rear end of the rail 440; and the front holder 460 supporting the idle pulley 510 such that the idle pulley 510 is rotational, and coupled to a front end of the rail 440.

The rail 440 may be formed of a metallic material. The rail 440 may be provided in the washing tub 30 to extend to be long in the first direction A and the second direction B. In detail, the rail 440 may extend at a middle part between the left wall 33 and the right wall 34 of the washing tub 30 to be long from the front of the washing tub 30 to the rear thereof.

The rail 440 may have a cylindrical shape having a lower opening 445 at a roughly lower portion thereof. That is, the rail 440 may include the inner space 441, an upper wall 442, a lower wall 444, opposite sidewalls 443, and the lower opening 445 formed in the lower wall 444. The lower opening 445 may extend from one end of the rail 440 to another end thereof in a lengthwise direction of the rail 440.

The reason why the rail 440 is provided to have the cylindrical shape is to provide the belt 520 in the inner space 441 of the rail 440, so that the belt 520 may be prevented from being in contact with dishes accommodated in the washing tub 30 not to interfere with driving of the belt 520 by the dishes or may be prevented from being in contact with washing water in the washing tub 30 not to be corroded.

Furthermore, the reason why the lower opening 445 is formed in the lower wall 444 of the rail 440 is to couple the belt 520 in the inner space 441 of the rail 440 to the vane 400 outside the rail 440 to transfer a driving force of the belt 520 to the vane 400.

The belt 520 may be wound around the driving pulley 500 and the idle pulley 510 to form a closed curve, and make a rotational motion in a rotational direction of the motor 530 when the motor 530 is driven. The belt 520 may be formed of a resin material containing aramid fiber in consideration of tensile strength, costs, etc.

A tooth form 521 may be formed on an internal side surface of the belt 520 to transfer the driving force of the belt 520 to the belt holder 480.

Similar to the belt 520, the belt holder 480 may be provided in the inner space 441 of the rail 440, and may be coupled to the tooth form 521 of the belt 520 to make a motion together with the belt 520. To this end, the belt holder 480 may include a tooth form coupler 481 to be coupled to the tooth form 521 of the belt 520.

The belt holder 480 may further include legs 482 and 483 supported by the rail 440. The legs 482 and 483 may include at least one lateral leg 482 protruding in a lateral direction and supported by the opposite sidewalls 443 of the rail 440, and a least one lower leg 483 protruding downward and supported by the lower wall 444 of the rail 440.

The at least one lateral leg 482 may be provided to be elastically transformable so as to decrease noise and vibration caused by collision or friction against the rail 440 during movement of the belt holder 480 and to smoothly move the belt holder 480.

The at least one lateral leg 482 may be an elastic body which is a type of leaf spring. That is, the at least one lateral leg 482 may include a curved plate which is elastically transformed between a relaxed form and a compressed form.

The belt holder 480 may further include an engaging unit 484 to be coupled to the vane holder 490. The engaging unit 484 may include an engaging hole 485 into which an engaging member 496 is inserted.

The vane holder 490 makes a motion together with the belt holder 480 while being coupled to the belt holder 480, and transfers a driving force of the belt holder 480 to the vane 400. The vane holder 490 is provided to cover an external surface of the rail 440 to be moved in the first direction A and the second direction B.

The vane holder 490 is coupled to the belt holder 480 via the lower opening 445 of the rail 440. To this end, the vane holder 490 may include an engaging hole 491 to be coupled to the belt holder 480. Thus, the vane holder 490 and the belt holder 480 may be coupled to each other by engaging the engaging member 496 into the engaging hole 491 of the vane holder 490 and the engaging hole 485 of the belt holder 480.

The engaging member 496 may be sequentially engaged in an upward direction with the engaging hole 491 of the vane holder 490 and the engaging hole 485 of the belt holder 480.

A coupling protrusion 493 may be formed on the vane holder 490, to which the vane 400 is detachably coupled. The coupling protrusion 493 may include a coupling shaft 494 protruding in a lateral direction, and a separation preventing unit 495 formed on an end of the coupling shaft 494 to prevent the vane 400 from being separated.

A casing 700 may be further formed on the vane holder 490. The casing 700 may be provided in front of the coupling protrusion 493. The casing 700 may be integrally formed with the vane holder 490 or may be formed separately from the vane holder 490 and coupled to the vane holder 490. The casing 700 may be coupled to a stopping unit 800 which fixes the vane 400 in a state in which the vane 400 is rotated.

The casing 700 may include a guide 710 and a partition 720. The guide 710 may include a first guide 710*a* and a second guide 710*b* to be apart from each other in front of the coupling protrusion 493. The first guide 710*a* and the second guide 710*b* may protrude towards a side of the vane holder 490, similar to the coupling protrusion 493. The partition 720 may be formed between the first guide 710*a* and the second guide 710*b* which are apart from each other. The partition 720 may form a first-rib accommodating space 730 and a second-rib accommodating space 740 into which the stopping unit 800 is inserted, together with the first guide 710*a* and the second guide 710*b*. In detail, the first-rib accommodating space 730 may be formed by one side of the vane holder 490, the first guide 710*a*, the second guide 710*b*, and the partition 720. The second-rib accommodating space 740 may be formed by the first guide 710*a*, the second guide 710*b*, and the partition 720. A surface of the second-rib accommodating space 740 facing the partition 720 may be open.

The driving pulley 500 includes a rotation axis 501, a shaft connector 503 coupled to a drive shaft 531 of the motor 530 to receive a driving force, and a belt coupler 502 to which the belt 520 is coupled.

The rear holder 450 supports the driving pulley 500 such that the driving pulley 500 is rotational, and is coupled to the rear end of the rail 440 facing the second direction B. The rear holder 450 includes a pulley support plane 451 supporting the rotation axis 501 of the driving pulley 500, a rail support plane 452 supporting the rear end of the rail 440, and an engaging hole 453 to be combined with a bottom plate cover 600.

The idle pulley 510 includes a rotation axis 511, and a belt coupler 512 to which the belt 520 is coupled.

The front holder 460 is coupled to the front end of the rail 440 facing the first direction A. The front holder 460 includes a front top holder 461, a front bottom holder 465 coupled to the bottom of the front top holder 461, and a pulley bracket 467 provided between the front top holder 461 and the front bottom holder 465 to be movable in a lengthwise direction of the rail 440 and supporting the idle pulley 510 such that the idle pulley 510 is rotational.

The front top holder 461 includes a pulley support plane 462 supporting the rotation axis 511 of the idle pulley 510, and a rail support plane 463 supporting the front end of the rail 440.

The front bottom holder 465 may be coupled to the bottom of the front top holder 461 due to a stopping structure thereof. The front bottom holder 465 may include a coupling protrusion 466 coupled to the bottom plate 35 of the washing tub 30.

The pulley bracket 467 includes a pulley support plane 468 supporting the rotation axis 511 of the idle pulley 510.

A push unit 900 protruding toward an outer side of the front holder 460 may be provided at a side of the front holder 460 to push out the stopping unit 800 in the second direction B. The push unit 900 may include a fixed portion 910 (see FIG. 13) fixed at a side of the front holder 460, and a pushing portion 920 (see FIG. 13) combined with the fixed portion 910 to protrude toward a lateral side of the front holder 460. The push unit 900 may be provided on the front top holder 461 but embodiments of the present invention are not limited thereto. The push unit 900 may be integrally formed with the front holder 460.

The rail 440, the belt 520, the driving pulley 500, the rear holder 450, the idle pulley 510, and the front holder 460 may be assembled together by tension of the belt 520.

That is, the driving pulley 500 is pressurized to be close to the rail 440 by the tension of the belt 520, the tension is transferred to the rear holder 450 via the pulley support plane 451 of the rear holder 450, and thus, the rear holder 450 is closely adhered to the rear end of the rail 440.

Furthermore, the idle pulley 510 is pressurized to be close to the rail 440 by the tension of the belt 520, the tension is transferred to the front holder 460 via the pulley support plane 462 of the front holder 460, and thus, the front holder 460 is closely adhered to the front end of the rail 440.

The front holder 460 may further include an elastic member 470 to maintain the tension of the belt 520, since the tension of the belt 520 decreases when the belt 520 is thermally expanded by heat inside the washing tub 30, and the vane 400 cannot be smoothly driven when the tension of the belt 520 decreases.

One end of the elastic member 470 may be supported by the front holder 460, and another end of the elastic member 470 may be supported by the pulley bracket 467. To this end, an elastic member support plane 464 may be provided on the front holder 460, and an elastic member support plane 469 may be provided on the pulley bracket 467.

The elastic member 470 may be a compression spring. The front holder 460 is supported by the rail 440 through the rail support plane 463 and thus an elasticity force of the elastic member 470 may be applied to the pulley bracket 467. That is, the pulley bracket 467 may be pressurized to be away from the rail 440 by the elasticity force of the elastic member 470.

In this case, since the pulley bracket 467 is pressurized to be close to the rail 440 by the tension of the belt 520, the pulley bracket 467 is moved to a location where the tension of the belt 520 and elasticity force of the elastic member 470 balance.

That is, when the belt 520 expands to decrease the tension thereof and the elasticity force of the elastic member 470 is greater than the tension of the belt 520, the pulley bracket 467 is moved to be away from the rail 440 by the elasticity force of the elastic member 470 and thus the belt 520 is pulled taut to restore the tension thereof.

Due to the above configuration, even when the belt 520 is thermally expanded, the pulley bracket 467 is moved to pull the belt 520 taut, thereby maintaining the tension of the belt 520 constant and improving the reliability of the driving device 420.

The rail assembly 430 may further include the stopping unit 800 which fixes the vane 400 in a state in which the vane 400 is rotated. The stopping unit 800 may be coupled to the casing 700 formed on the vane holder 490 and thus be moved along the rail 440 together with the vane holder 490.

The stopping unit 800 may be coupled to the casing 700 to be slidable in the first direction A and the second direction B.

The stopping unit 800 may include a first rib 820, a second rib 830, a connector 840, and a support protrusion 810. The first rib 820 and the second rib 830 may be different in length. The first rib 820 may be longer than the second rib 830. The first rib 820 may be inserted into the first-rib accommodating space 730 of the casing 700 to be moved along a side surface of the vane holder 490 in the first direction A and the second direction B. The second rib 830 may be coupled to the second-rib accommodating space 740 of the casing 700 to be moved along the partition 720 in the first direction A and the second direction B. One end of the first rib 820 and one end of the second rib 830 are connected via the connector 840 and thus the first rib 820 and the second rib 830 may be moved as one body. The support protrusion 810 may be formed at a side of the second rib 830. The support protrusion 810 may be formed at a side of the second rib 830 to protrude toward an outer side of the second-rib accommodating space 740 via an open surface of the second-rib accommodating space 740 facing the partition 720. A stopping protrusion 1000 of the vane 400 may be supported by the support protrusion 810 to fix the vane 400 in a state in which the vane 400 is rotated.

A process of assembling the rail assembly 430 of the dishwasher 1 will be described below.

As illustrated in FIG. 4, the belt holder 480 is combined with the belt 520.

As illustrated in FIG. 5, an assembly of the belt 520 and the belt holder 480 is provided in the inner space 441 of the rail 440. Next, the vane holder 490 is combined with the assembly of the belt 520 and the belt holder 480 through the engaging member 496.

As illustrated in FIG. 6, the rear holder 450 is assembled with the rear end of the rail 440 in the lengthwise direction of the rail 440. Next, the driving pulley 500 is coupled to the belt 520.

As illustrated in FIG. 8, the front top holder 461 is coupled to the front end of the rail 440 in the lengthwise direction of the rail 440. Next, the belt 520, the idle pulley 510, the pulley bracket 467, and the elastic member 470 are combined with one another. Next, an assembly of the belt 520, the idle pulley 510, the pulley bracket 467, and the elastic member 470 is inserted into the front top holder 461. Next, the front bottom holder 465 is coupled to the front top holder 461.

Figure 10:
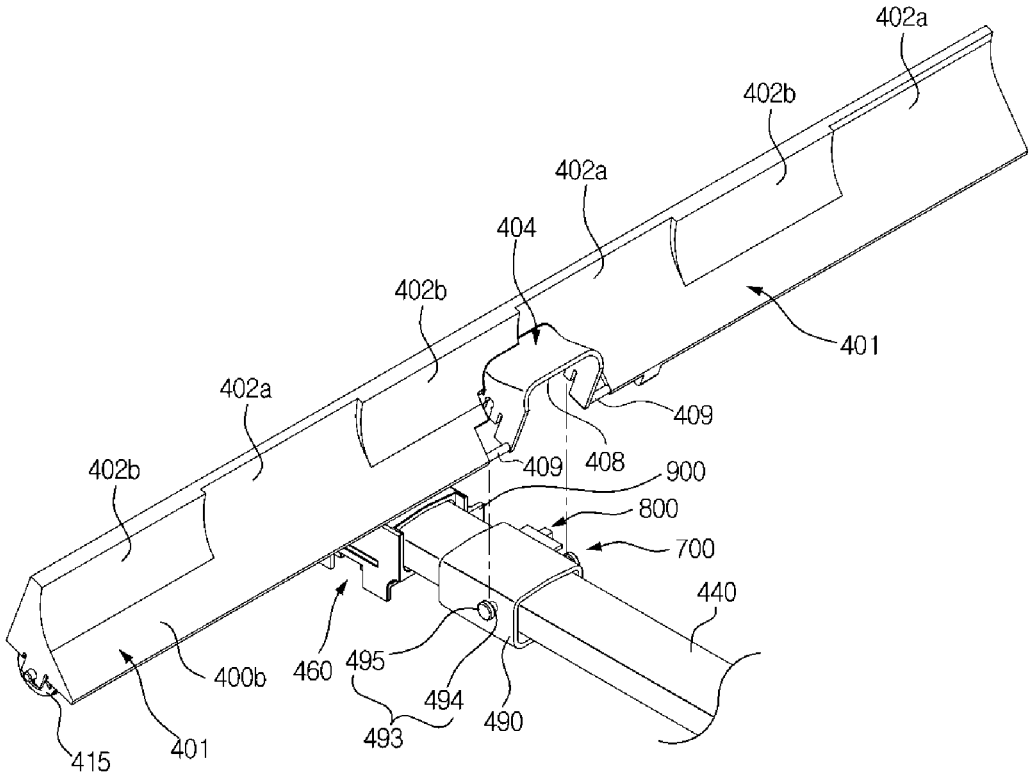
FIG. 10 is a diagram illustrating a vane and a vane holder of the dishwasher of FIG. 1.
Figure 11:
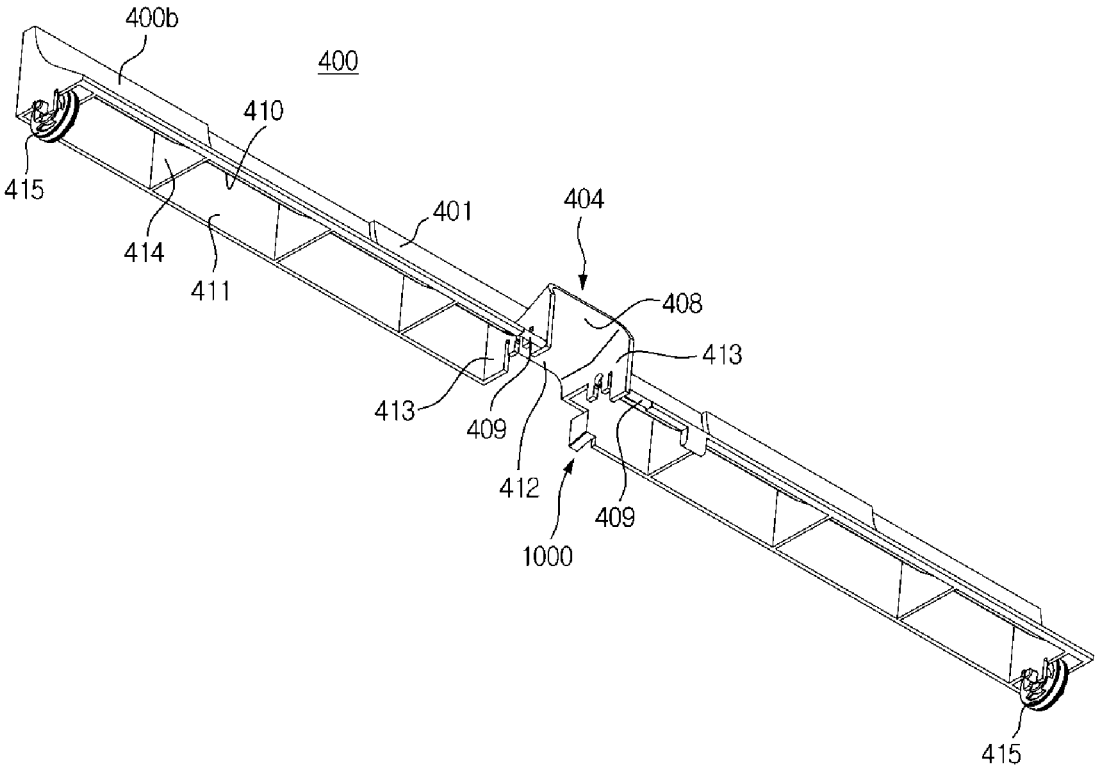
FIG. 11 is a perspective view of a vane of the dishwasher of FIG. 1.
Figure 12:
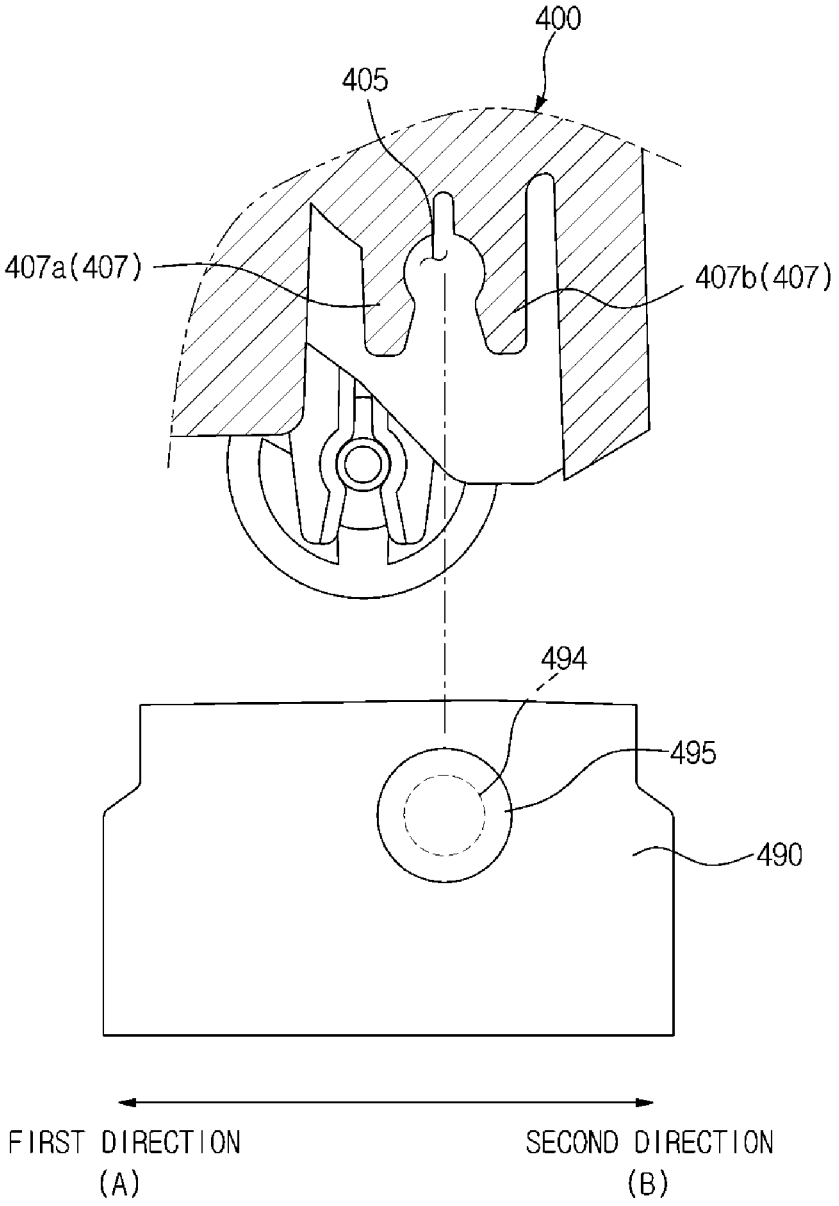
FIG. 12 is an expanded view of parts of a vane and a vane holder of the dishwasher of FIG. 1.

FIG. 10 is a diagram illustrating a vane and a vane holder of the dishwasher of FIG. 1. FIG. 11 is a perspective view of a vane of the dishwasher of FIG. 1. FIG. 12 is an expanded view of parts of a vane and a vane holder of the dishwasher of FIG. 1. In the case of reference numerals that are not shown in FIGS. 10 to 12, the corresponding reference numerals illustrated in FIGS. 1 to 9 should be referred to. Furthermore, parts of FIGS. 10 to 12 that are the same as those described above with reference to FIGS. 1 to 9 may not be redundantly described here. Hereinafter, the term 'hook' should be understood as being identical to elastic hooks 407.

As illustrated in FIGS. 10 to 12, the vane 400 may extend to be long perpendicularly to the rail 440.

The vane 400 may be rotated on the front end of the rail 440 facing the first direction A such that an upper end thereof faces the first direction A, and may be rotated on the rear end of the rail 440 facing the second direction B such that the upper end thereof faces the second direction B.

The vane 400 may include a reflector 401 which reflects washing water sprayed via the fixed nozzles 330 and 340, an upper support unit 410 which bents from the reflector 401, a rear support unit 411 which bents from the upper support unit 410, a cap unit 404 provided a middle part of the reflector 401 in a lengthwise direction of the reflector 401, a rotation stopper 409 provided to interfere with a rotation guide 610 (see FIG. 16) of the bottom plate cover 600, a reinforcing rib 414 provided to increase the strength of the reflector 401, the upper support unit 410, and the rear support unit 411, a rotation limiting unit 412 supported on an upper surface of the vane holder 490, and a vertical support unit 413 supported on a side surface of the vane holder 490.

The vane 400 may include a first surface 400*a* facing the first direction A, and a second surface 400*b* facing the second direction B. The rotation limiting unit 412 may be formed on the first surface 400*a* of the vane 400. The reflector 401, the rotation stopper 409, and the cap unit 404 may be formed on the second surface 400*b* of the vane 400.

The rotation limiting unit 412 may be located above the vane holder 490 to face an outer surface of the vane holder 490, and a degree to which the rotation limiting unit 412 is separated from the vane holder 490 may change as the vane 400 is rotated. In detail, when the push unit 900 pushes out the connector 840 of the stopping unit 800 in the second direction B, the degree to which the rotation limiting unit 412 is separated from the vane holder 490 may decrease as the vane 400 is rotated. In contrast, when the rotation guide 610 (see FIG. 16) interferes with the rotation stopper 409, the degree to which the rotation limiting unit 412 is separated from the vane holder 490 may increase as the vane 400 is rotated.

The stopping protrusion 1000 protruding in the first direction A may be further formed on the first surface 400*a* of the vane 400. The stopping protrusion 1000 may be formed close to the rotation limiting unit 412 but embodiments of the present invention are not limited thereto. The stopping protrusion 1000 may be supported by the support protrusion 810 of the stopping unit 800 to fix the vane 400 in a state in which the vane 400 is rotated.

The reflector 401 includes inclined reflecting planes 402*a* and 402*b* to reflect washing water. The reflecting planes 402*a* and 402*b* may include the reflecting plane 402*a* and the reflecting plane 402*b* having different slopes to reflect washing water at different angles and alternately arranged in a lengthwise direction thereof.

The cap unit 404 may include a coupling groove 405 to be combined with the vane holder 490, and a rotation stopper 408 which limits a range of rotation of the vane 400 when the vane 400 is rotated by the rotation guide 610 of the bottom plate cover 600.

The coupling groove 405 of the vane 400 may be combined with the coupling protrusion 493 of the vane holder 490. In detail, the coupling shaft 494 of the coupling protrusion 493 may be inserted into the coupling groove 405 of the vane 400. The coupling shaft 494 may support the vane 400 such that the vane 400 is rotational.

As illustrated in FIG. 12, the coupling groove 405 of the vane 400 may be formed by the elastic hooks 407. The elastic hooks 407 may be elastically deformed to be open when the coupling shaft 494 of the vane holder 490 is inserted into or separated from the coupling groove 405 of the vane 400, and to be restored to the original state thereof when the insertion or separation of the coupling shaft 494 is completed. Due to the above configuration, the vane 400 may be mounted into or separated from the vane holder 490.

The elastic hooks 407 may include a first hook 407*a* and a second hook 407*b*. The first hook 407*a* faces the first direction A and the second hook 407*b* faces the second direction B with respect to the coupling protrusion 493. The number of the elastic hooks 407 is not limited to '2'.

Rollers 415 may be provided at opposite ends of the vane 400 in a lengthwise direction of the vane 400 to smoothly move the vane 400. A roller support unit (not shown) supporting the rollers 415 may be provided on the bottom plate 35 of the washing tub 30.

Figure 13:
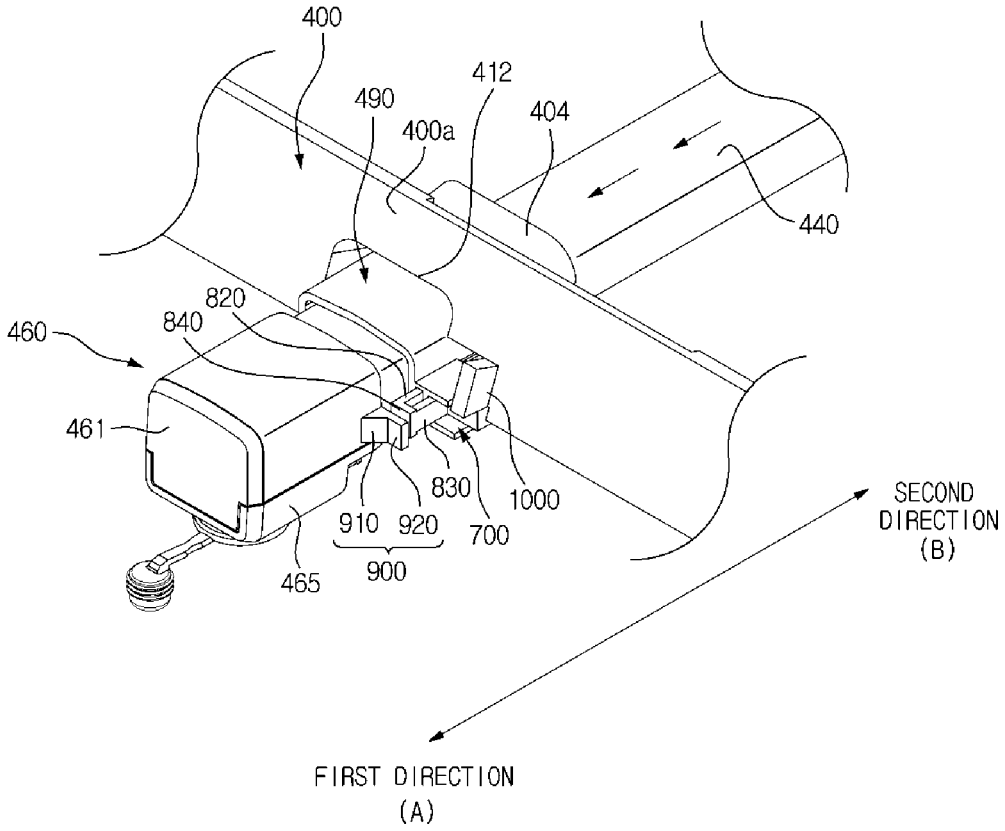
FIGS. 13 and 14 are diagrams illustrating a state in which a vane of the dishwasher of FIG. 1 is moved in a first direction.
Figure 14:
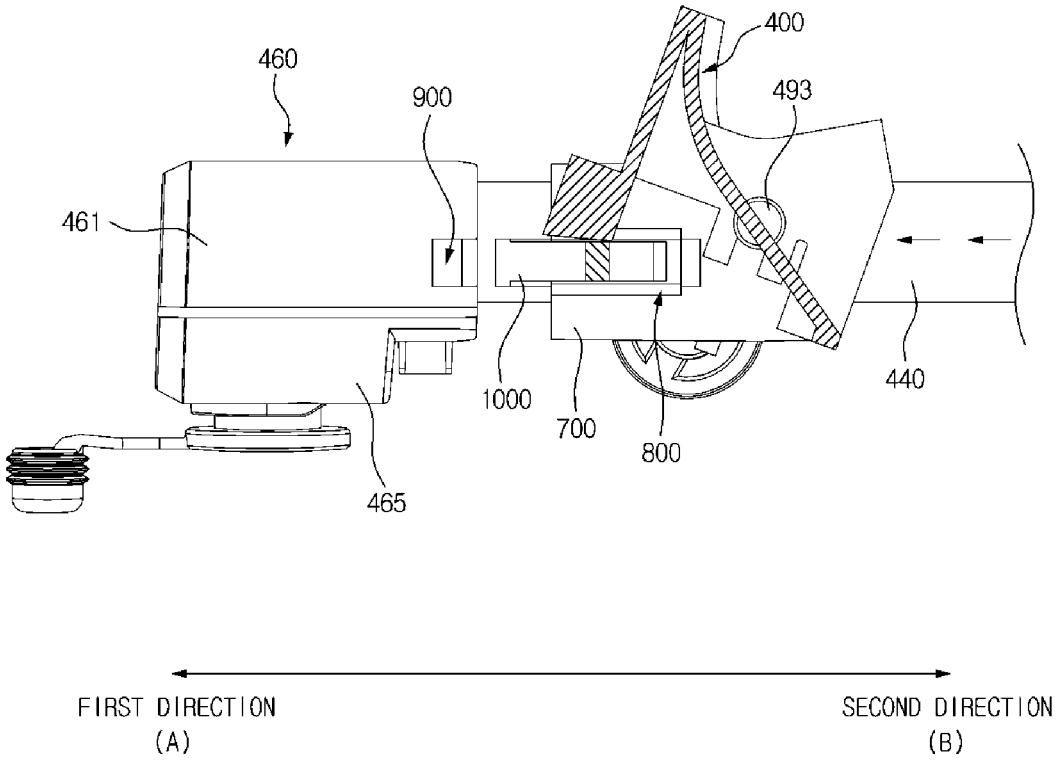
Figure 15:
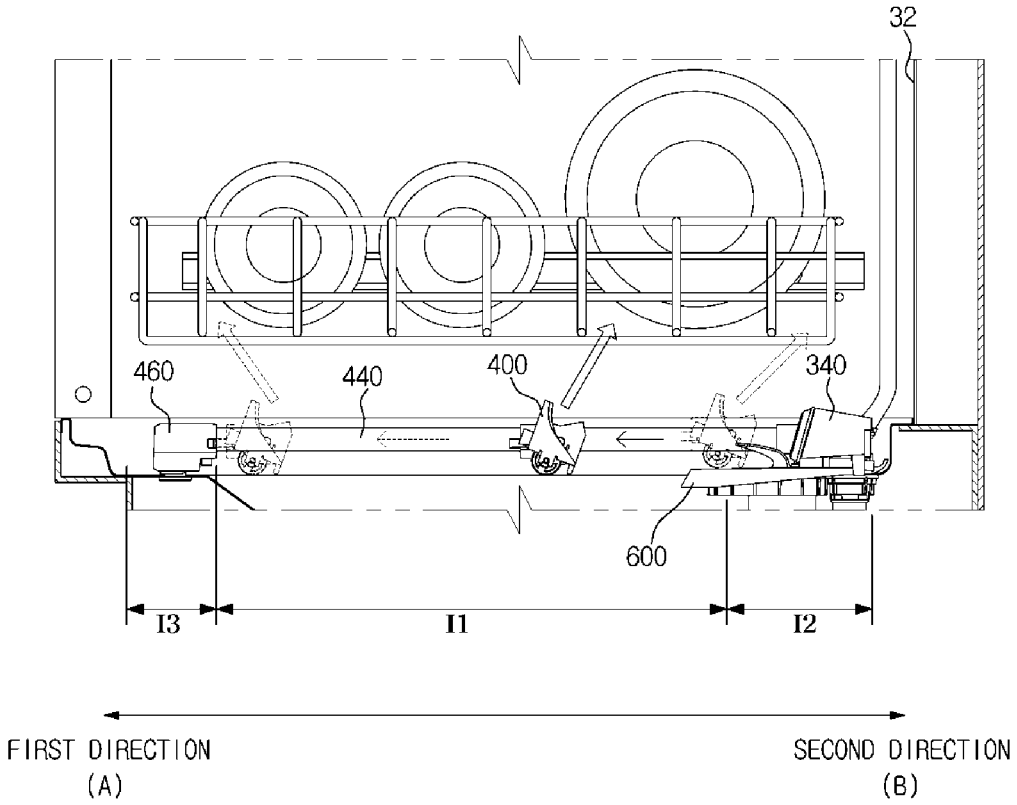
FIG. 15 is a diagram illustrating reflecting washing water, performed by the vane of FIGS. 13 and 14.

FIGS. 13 and 14 are diagrams illustrating a state in which a vane of the dishwasher of FIG. 1 is moved in a first direction. FIG. 15 is a diagram illustrating reflecting washing water, performed by the vane of FIGS. 13 and 14. Here, parts that are the same as those described above with reference to FIGS. 1 to 12 may not be redundantly described. In the case of reference numerals that are not shown here, the corresponding reference numerals illustrated in FIGS. 1 to 12 should be referred to.

As illustrated in FIGS. 13 to 15, the dishwasher 1 has a vane movement section I1 in which the vane 400 may be moved, and non-vane movement sections I2 and 13 in which the vane 400 cannot be moved.

The vane 400 of the dishwasher 1 according to an embodiment of the present invention may be provided to be rotational so as to wash dishes accommodated in the non-vane movement sections I2 and I3.

A process of washing the dishes accommodated in the non-vane movement section I3 by the vane 400 of the dishwasher 1 will be described below. The vane 400 may be moved in the first direction A in a state in which the stopping protrusion 1000 thereof is supported by the support protrusion 810 of the stopping unit 800. When the vane 400 arrives at the front end of the rail 440, the push unit 900 of the front holder 460 pushes out the connector 840 of the stopping unit 800 in the second direction B. Thus, the first rib 820 and the second rib 830 of the stopping unit 800, and the support protrusion 810 formed on the second rib 830 slide in the second direction B. The first rib 820 sliding in the second direction B pushes out the first hook 407*a* in the second direction B and thus the vane 400 is rotated about the coupling protrusion 493 such that the upper end of the vane 400 faces the first direction A.

The rotation limiting unit 412 formed on the first surface 400*a* of the vane 400 is supported on the vane holder 490 and limits the rotation of the vane 400. The vane 400 is moved along the rail 440 in the second direction B while being fixed in a state in which the rotation limiting unit 412 is supported on the vane holder 490.

Figure 16:
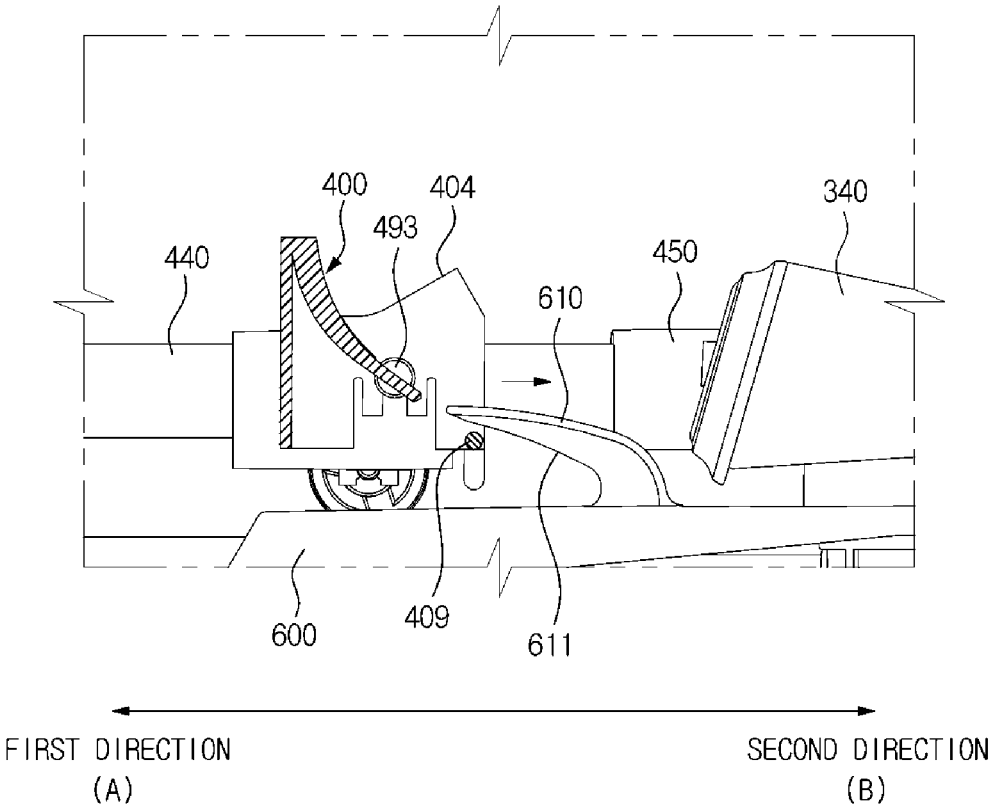
FIG. 16 is a diagram illustrating a state in which the vane of the dishwasher of FIG. 1 is moved in a second direction.
Figure 17:
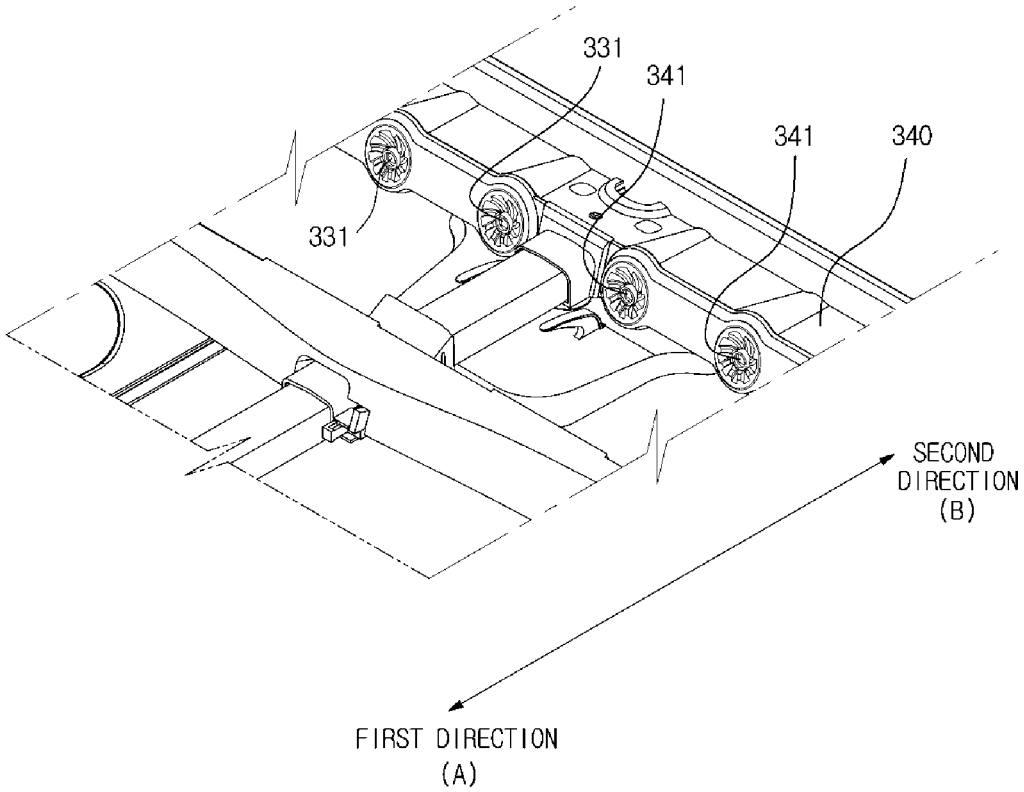
FIGS. 17 and 18 are diagrams illustrating another aspect of a state in which the vane of the dishwasher of FIG. 1 is moved in the second direction.
Figure 18:
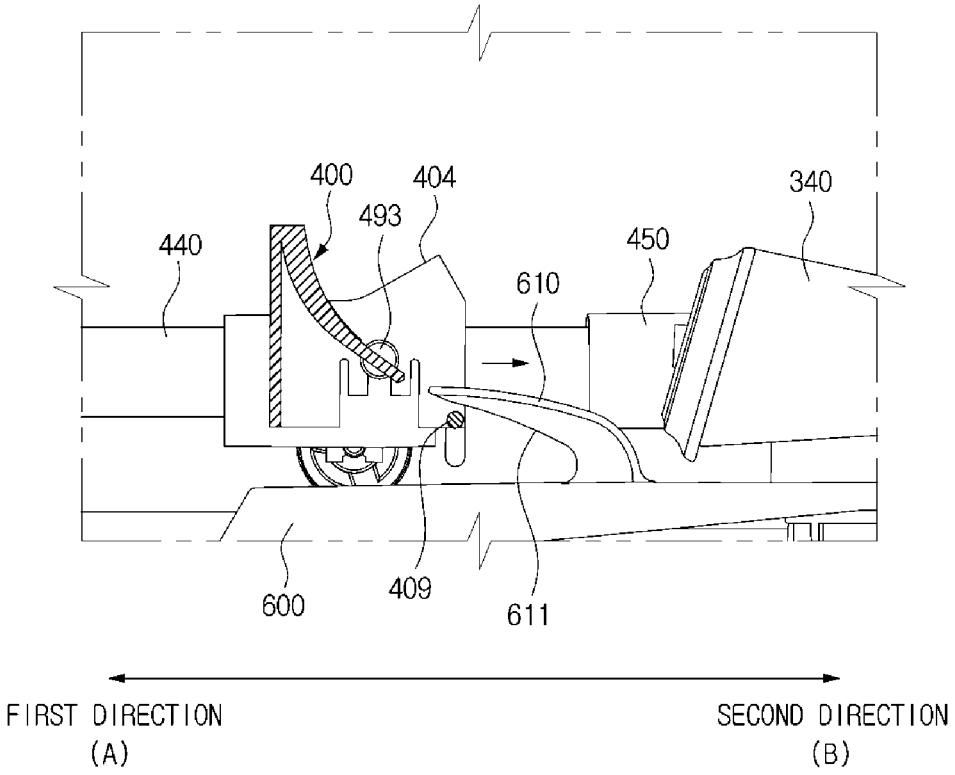
Figure 19:
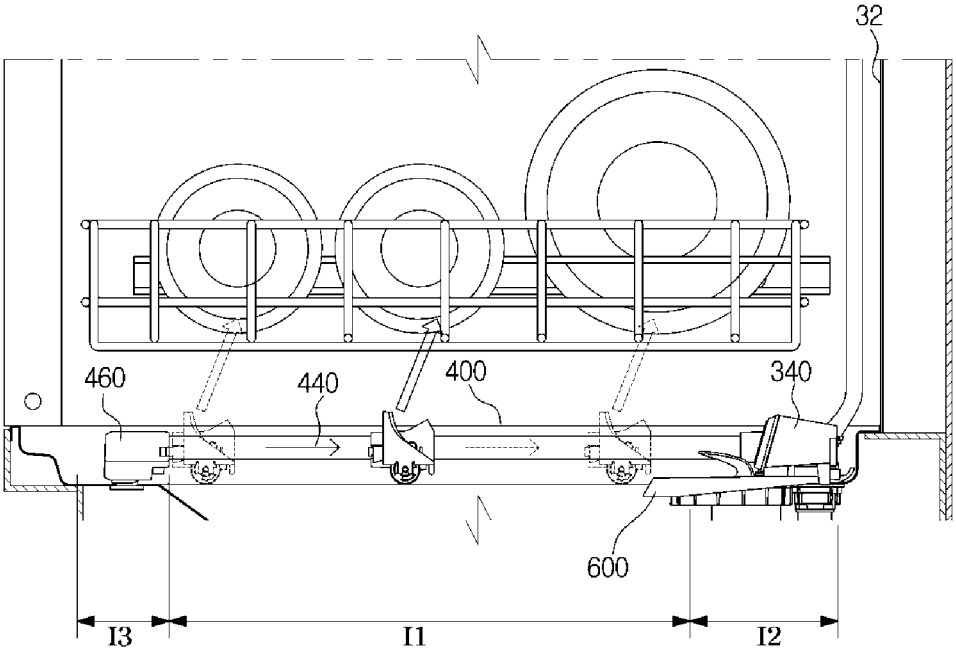
FIG. 19 is a diagram illustrating reflecting washing water, performed by the vane of FIGS. 17 and 18.

FIG. 16 is a diagram illustrating a state in which the vane of the dishwasher of FIG. 1 is moved in a second direction. FIGS. 17 and 18 are diagrams illustrating another aspect of a state in which the vane of the dishwasher of FIG. 1 is moved in the second direction. FIG. 19 is a diagram illustrating reflecting washing water, performed by the vane of FIGS. 17 and 18. Here, parts that are the same as those described above with reference to FIGS. 1 to 12 may not be redundantly described. In the case of reference numerals that are not shown here, the corresponding reference numerals of FIGS. 1 to 12 should be referred to.

As illustrated in FIGS. 16 to 19, a process of washing dishes accommodated in the non-vane movement section I2 by the vane 400 of the dishwasher 1 will be described below.

The vane 400 of the dishwasher 1 reflects washing water sprayed via the fixed nozzles 330 and 340 toward dishes. Since the fixed nozzles 330 and 340 spray the washing water in a roughly horizontal direction, the fixed nozzles 330 and 340 are located roughly horizontally with respect to the vane 400. Thus, the vane 400 cannot be moved in a region in which the fixed nozzles 330 and 340 are arranged. That is, for the above reason, the dishwasher 1 may have the non-vane movement section I2 in which the vane 400 cannot be moved.

As described above, the rotation guide 610 protruding to guide the movement of the vane 400 is formed on the bottom plate cover 600, and the rotation stopper 409 is formed on the vane 400 to interfere with the rotation guide 610. The rotation stopper 409 may form an axis of rotation of the vane 400.

The rotation guide 610 includes a guide plane 611 formed to be in contact with the rotation stopper 409 and to have a curved surface so that the vane 400 may be smoothly rotated.

The vane 400 may be moved in the second direction B in a state in which the rotation limiting unit 412 formed on the first surface 400*a* of the vane 400 is supported on the vane holder 490. If the rotation stopper 409 of the vane 400 interferes with the guide plane 611 of the rotation guide 610 of the bottom plate cover 600 when the vane 400 arrives from the vane movement section I1 to the non-vane movement section I2, the vane 400 is rotated about the coupling protrusion 493 of the vane holder 490 such that the upper end thereof faces the second direction B. Thus, washing water may be reflected toward dishes in the non-vane movement section I2.

The vane 400 rotated such that the upper end thereof faces the second direction B is moved along the rail 440 in the first direction A while being fixed in a state in which the stopping protrusion 1000 formed on the first surface 400*a* of the vane 400 is supported on the support protrusion 810 of the stopping unit 800.

While the present invention has been particularly shown and described with reference to exemplary embodiments thereof, the present invention is not limited thereto and it will be understood by those of ordinary skill in the art that various changes in form and details may be made therein without departing from the spirit and scope of the invention as defined by the appended claims.

The invention claimed is:

1. A dishwasher in which dishes are containable, comprising:

a main body;

a washing tub provided in the main body;

a door configured to close or open a first side of the washing tub;

a fixed nozzle fixed on a second side of the washing tub and configured to spray water;

a vane configured to be movable along a linear axis within the washing tub and to reflect the water sprayed from the fixed nozzle toward dishes contained in the dishwasher while the vane is being moved along the linear axis within the washing tub; and a rail assembly extending along the linear axis and configured to guide movement of the vane along the linear axis, wherein the vane is rotationally coupled to the rail assembly with an axis of rotation of the vane being substantially perpendicular to the linear axis, so that the vane rotates on the axis of rotation to change a direction of the reflected water.

2. The dishwasher of claim 1, wherein the vane is configured to be rotated at opposite ends of the rail assembly.

3. The dishwasher of claim 1, wherein the rail assembly comprises:

a rail extending between the door and the fixed nozzle along the linear axis; and a vane holder coupled to the rail to be moved a first direction along the linear axis and a second direction opposite the first direction along the linear axis, the vane is coupled to the vane holder to be moved as one body with the vane holder along the rail.

4. The dishwasher of claim 3, wherein the vane holder comprises:

a coupling protrusion protruding toward an outer side of the vane holder such that the vane is rotationally coupled to the vane holder; and a casing integrally formed with the vane holder to be provided in front of the coupling protrusion.

5. The dishwasher of claim 4, wherein the rail assembly further comprises a stopping unit configured to fix the vane in a position of rotation, the stopping unit is coupled to the casing to be moved along the rail together with the vane holder.

6. The dishwasher of claim 5, wherein a stopping protrusion protruding in the first direction is provided on a first surface of the vane facing the first direction, the stopping protrusion is supported by the stopping unit to fix the vane in a the position of rotation.

7. The dishwasher of claim 5, wherein the rail assembly further comprises a holder formed on one end of the rail facing the first direction, a push unit protruding toward an outer side of the holder is provided at a side of the holder to push out the stopping unit in the second direction.

8. The dishwasher of claim 7, wherein the vane comprises:

a coupling groove combined with the coupling protrusion; and a plurality of hooks forming the coupling groove.

9. The dishwasher of claim 8, wherein, when the push unit pushes out one end of the stopping unit in the second direction, another end of the stopping unit pushes out one of the plurality of hooks in the second direction to rotate the vane about the coupling protrusion.

10. The dishwasher of claim 6, further comprising a bottom plate cover coupled to one side of a bottom plate of the washing tub and the fixed nozzle, wherein a rotation guide protruding toward the first direction is provided on the bottom plate cover.

11. The dishwasher of claim 10, wherein a rotation stopper is provided on a second surface of the vane facing the second direction to correspond to the rotation guide, the rotation guide interferes with the rotation stopper to rotate the vane, and the vane is fixed in the position of rotation while the stopping protrusion is supported by the stopping unit.

12. A dishwasher in which dishes are containable, comprising:

a main body;

a washing tub provided in the main body;

a door configured to close or open an open front of the washing tub;

a fixed nozzle fixed on a rear of the washing tub and configured to spray water;

a bottom plate cover coupled to a rear of a bottom plate of the washing tub to be coupled to the fixed nozzle;

a vane configured to be movable along a linear axis within the washing tub and to reflect the water sprayed from the fixed nozzle toward dishes contained in the dishwasher while the vane is being moved along the linear axis within the washing tub; and a rail assembly extending along the linear axis and configured to guide movement of the vane along the linear axis, wherein the rail assembly comprises:

a rail extending along the front and rear of the washing tub;

a vane holder coupled to the rail to be moved along the rail, and the vane is coupled to the vane holder, with an axis of rotation of the vane being substantially perpendicular to the linear axis, so that the vane rotates on the axis of rotation at opposite ends of the rail and the vane moves along the rail while being fixed in a position of rotation.

13. The dishwasher of claim 12, wherein the vane is rotationally coupled to an outer side of the vane holder, and a rotation limiting unit facing an outer surface of the vane holder is formed on a first surface of the vane facing the front of the washing tub, wherein a degree to which the rotation limiting unit is separated from the vane holder changes as the vane is rotated.

14. The dishwasher of claim 13, wherein the vane holder comprises a coupling protrusion protruding toward the outer side thereof such that the vane is rotatably coupled to the vane holder.

15. The dishwasher of claim 14, wherein the rail assembly further comprises a stopping unit coupled to one side of the vane holder to be provided in front of the coupling protrusion, and configured to be moved along the rail together with the vane holder.

16. The dishwasher of claim 15, wherein the rail assembly further comprises a holder formed on one end of the rail facing the front of the washing tub, a push unit protruding toward an outer side of the holder is provided at a side of the holder to push out the stopping unit toward the rear of the washing tub.

17. The dishwasher of claim 16, wherein, when the push unit pushes out one end of the stopping unit toward the rear of the washing tub, the vane is rotated to decease the degree to which the rotation limiting unit is separated from the vane holder.

18. The dishwasher of claim 17, wherein the rotation limiting unit is supported on the vane holder to limit the rotation of the vane, and the vane is moved along the rail toward the rear of the washing tub while being fixed in a position of rotation which the rotation limiting unit is supported on the vane holder.

19. The dishwasher of claim 15, wherein a rotation guide protruding toward the front of the washing tub is provided on the bottom plate cover.

20. The dishwasher of claim 19, wherein a rotation stopper is provided on a second surface of the vane facing the rear of the washing tub to correspond to the rotation guide, and when the rotation guide interferes with the rotation stopper, the vane is rotated to increase the degree to which the rotation limiting unit is separated from the vane holder.

* * * * *